US006935900B2

(12) United States Patent
Wan et al.

(10) Patent No.: US 6,935,900 B2
(45) Date of Patent: Aug. 30, 2005

(54) MODULAR JACK HAVING AN ANTI-MISMATING MEMBER TO PREVENT INCORRECT INSERTION OF A SMALLER SIZED PLUG

(75) Inventors: Qing Wan, Kunsan (CN); Qisheng Zheng, Kunsan (CN); Hong Jun Wang, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/842,760

(22) Filed: May 10, 2004

(65) Prior Publication Data

US 2004/0224565 A1 Nov. 11, 2004

(30) Foreign Application Priority Data

May 9, 2003 (TW) ..... 92208560 U

(51) Int. Cl.[7] ..... H01R 13/64
(52) U.S. Cl. ..... 439/677; 439/676
(58) Field of Search ..... 439/677, 680, 439/676

(56) References Cited

U.S. PATENT DOCUMENTS 6,186,835 B1 2/2001 Cheshire
6,257,935 B1 7/2001 Zhang et al.
6,296,528 B1 10/2001 Roberts et al.
6,416,364 B1 * 7/2002 Shi et al. ..... 439/680
6,458,001 B1 * 10/2002 Chen et al. ..... 439/680
6,702,622 B2 * 3/2004 Sato et al. ..... 439/676

* cited by examiner

*Primary Examiner*—Cary Paumen
(74) *Attorney, Agent, or Firm*—Wei Te Chung

(57) ABSTRACT

A modular jack (100) includes an insulative housing (2) with a plug-receiving cavity (24), an anti-mismating member (3) and a terminal module (4) received in the housing, and a metal shell (6) shielding the housing. The anti-mismating member (3) is formed by one metal sheet and includes a pair of cantilevered branch portions (32) extending forwardly into the plug-receiving cavity. Each branch portion includes a stopping tab (33) projecting upright from an inner side thereof and a guiding portion (34) extending upwardly from an outer side thereof. Each stopping tab has an engaging surface (331) facing forwardly. Each guiding portion has an inclined guiding surface (341) in front of the engaging surface.

2 Claims, 4 Drawing Sheets

MODULAR JACK HAVING AN ANTI-MISMATING MEMBER TO PREVENT INCORRECT INSERTION OF A SMALLER SIZED PLUG

BACKGROUND OF THE INVENTION

1. Field of the Invention

The present invention relates to a connector, and especially to a modular jack designed to prevent improper insertion of a smaller sized plug connector.

2. Description of the Related Art

A modular jack is usually provided with an anti-mismating member for preventing an improper insertion of undersized plugs. U.S. Pat. No. 6,186,835 B1 issued to Cheshire on Feb. 13, 2001 discloses a modular jack for preventing incorrect insertions of smaller sized plugs. The modular jack comprises an insulative housing and an anti-mismating member integrally formed in a jack cavity of the housing. The anti-mismating member is composed of a flexible ramp projecting into an entry of the jack cavity. The ramp has an inner movable end with a vertical barrier. An inserted undersized plug is too small to touch the flexible ramp and thus fails to downwardly deflect the vertical barrier. As a result, the vertical barrier remains in its stopping position. The inserted undersized plug is blocked by the vertical barrier. When a full-sized plug is inserted into the modular jack, the full-sized plug engages with the ramp, riding along and downwardly deflecting the flexible ramp, making the vertical barrier move away a stopping position thereof, allowing full-sized inserted plug to be fully seated in the jack cavity. However, the anti-mismating member is made from plastic material and tends to lose flexibility after repeated use. Moreover, a large force exerted by the anti-mismating member is required to allow the fully insertion of the full-sized plug. The anti-mismating member is susceptible to damage or fracture on the housing, resulting in a short life-span.

U.S. Pat. No. 6,296,528 B1 issued to Roberts et al on Oct. 2, 2001 disclosed another conventional modular jack. The modular jack comprises an insulative housing defining a plug-receiving cavity and a pair of anti-mismating members received in the insulative housing. Each anti-mismating member comprises a sliding surface and a stop surface attached to an inner side of the sliding surface. The stop surface is provided for blocking an undersized plug being inserted. When a mating plug is inserted into the cavity, an upper surface of the mating plug contacts the sliding surface before reaching the stop surface and rides along the sliding surface, which causes the sliding surface to upwardly move. The movement produces a corresponding movement in the anti-mismating member and the stop surface thereon such that the stop surface is displaced out of a stop position, permitting full insertion of the mating plug into the cavity. When an undersized plug is inserted into the cavity, an upper surface of the undersized plug contacts the stop surface, preventing full insertion of the undersized plug into the cavity. However the pair of anti-mismating members are made separately and have to be separately assembled to the modular jack. Too more constituent parts produce an incompact frame resulting in a complicated assembling process.

BRIEF SUMMARY OF THE INVENTION

An object of the present invention is to provide a modular jack with a simple anti-mismating member having a longer-life for preventing an improper insertion of an undersized plug.

In order to achieve the object set forth, A modular jack includes an insulative housing with a plug-receiving cavity, an anti-mismating member and a terminal module received in the housing, and a metal shell shielding the housing. The anti-mismating member is formed by one metal sheet and includes a pair of cantilevered branch portions extending forwardly into the plug-receiving cavity. Each branch portion includes a stopping tab projecting upright from an inner side thereof and a guiding portion extending upwardly from an outer side thereof. Each stopping tab has an engaging surface facing forwardly. Each guiding portion has an inclined guiding surface in front of the engaging surface.

DETAILED DESCRIPTION OF THE INVENTION

Figure 1:
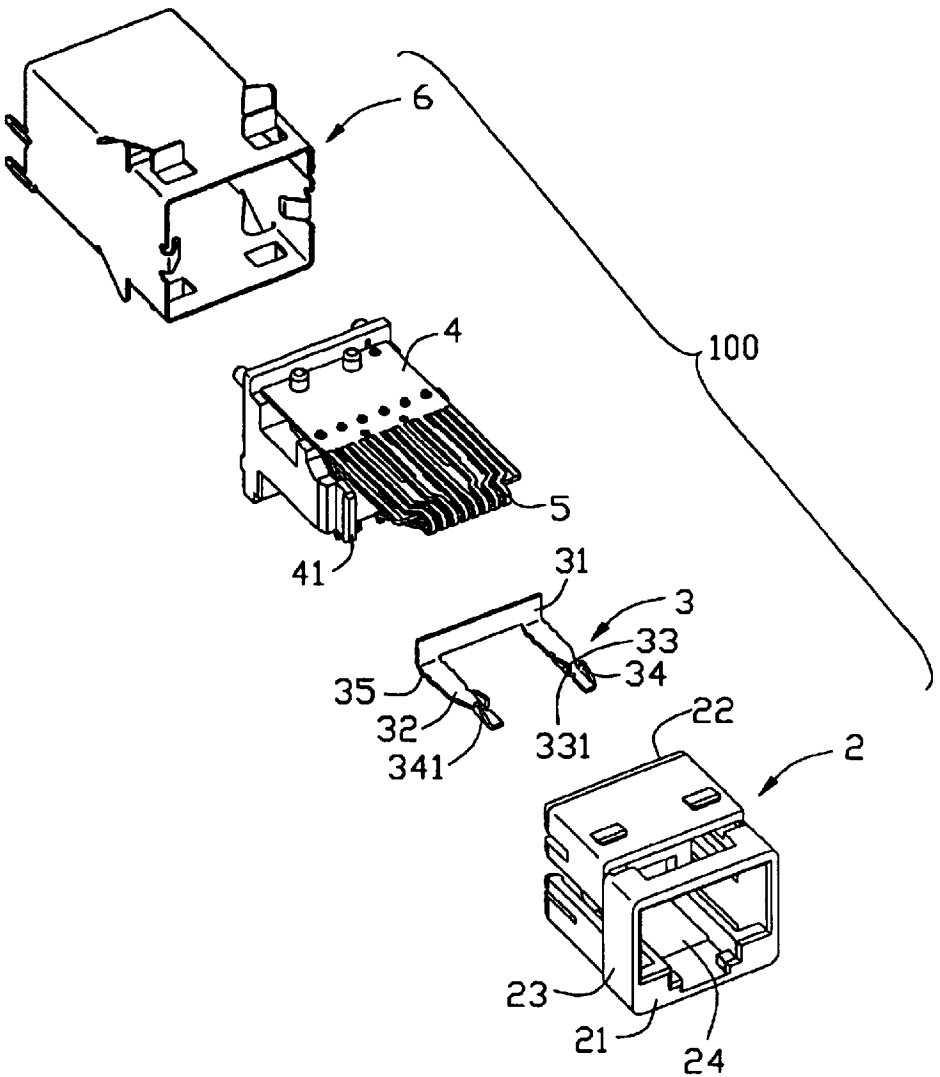
FIG. 1 is an exploded view of a modular jack according to the present invention.
Figure 2:
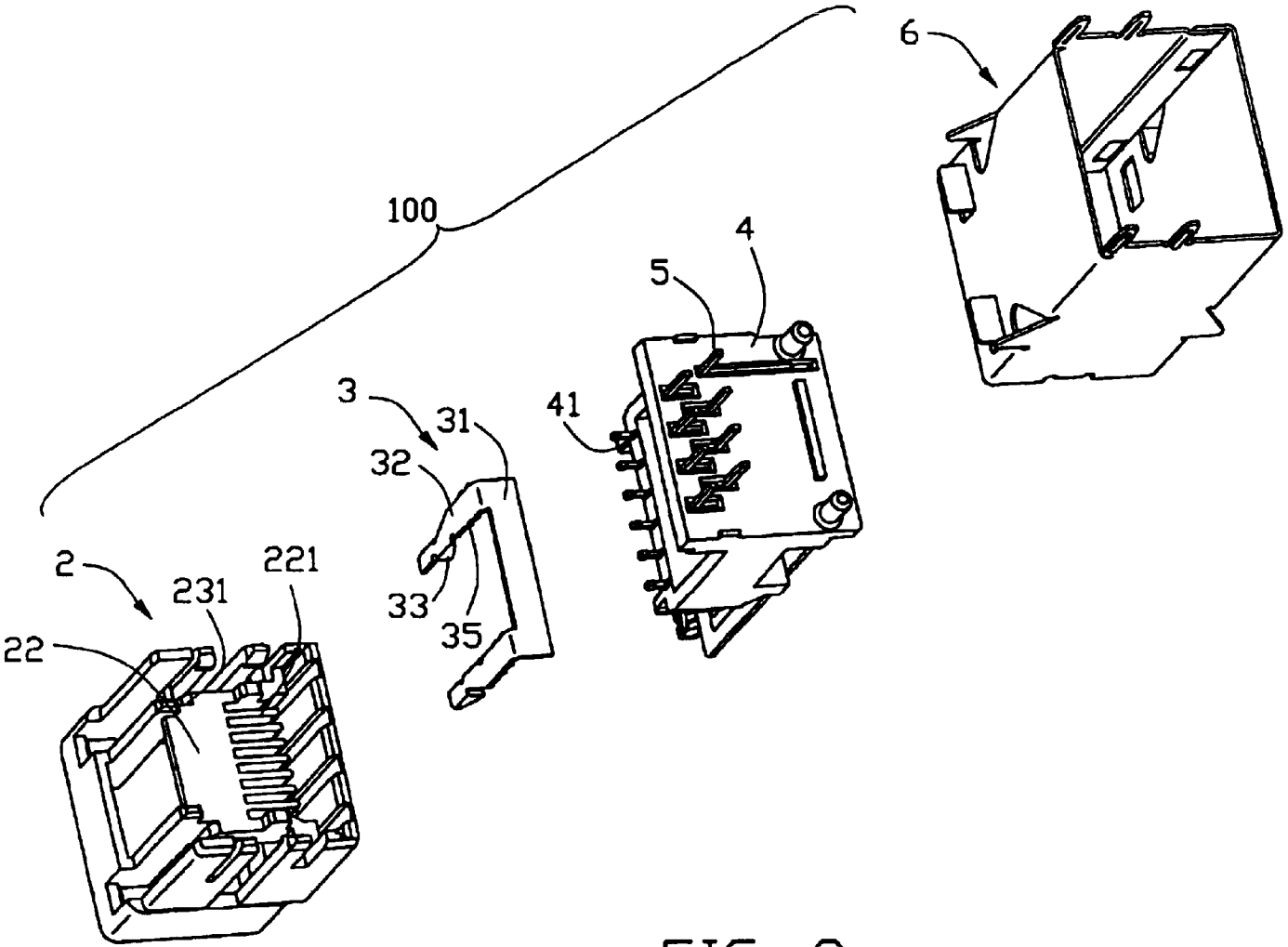
FIG. 2 is another exploded view of the modular Jack of FIG. 1 from a different aspect.
Figure 3:
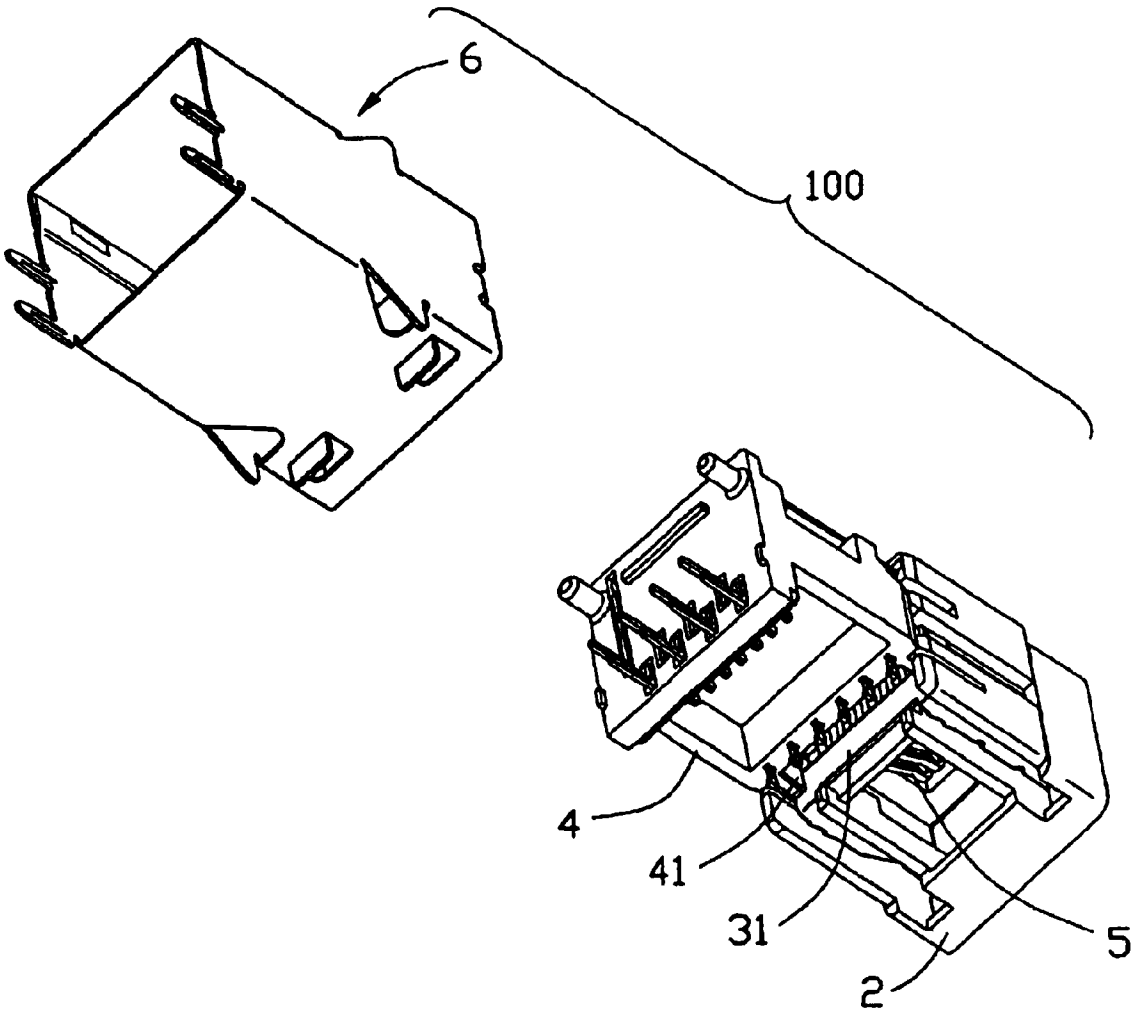
FIG. 3 is a partially assembled view of the modular Jack.

Referring to FIGS. 1 and 3, a modular jack 100 in accordance with the present invention is adapted for receiving a mating plug such as an RJ-45 type plug (not shown). The modular jack 100 comprises an insulative housing 2, an anti-mismating member 3, a terminal module 4 received in the housing 2 and a metal shell 6 shielding the insulative housing 2. The anti-mismating member 3 is provided for blocking full insertion of a non-complementary plug, such as an RJ-11 type plug (not shown), as will be discussed more detail herein.

The housing 2 is substantially rectangular and is made from insulative material. The housing 2 comprises a front wall 21, a rear wall 22 and a pair of side walls 23. The housing 2 includes a plug-receiving cavity 24 defined through the front wall 21 for receiving the RJ-45 plug (not shown). Each side wall 23 defines a horizontal groove 231 in a substrate middle portion thereof. The grooves 231 extend rearwardly through the rear wall 22 and communicate with the cavity 24. Each groove 231 includes a plurality of recesses (not labeled) on opposite sides thereof. A plurality of slits 221 are defined in the rear wall 22.

The anti-mismating member 3 is substantially L-shaped and is secured in the groove 231. The anti-mismating member 3 is integrally made of a metal sheet and comprises a pair of cantilevered branch portions 32 joined by a connecting wall 31. The branch portions 32 extend forwardly and are substantially perpendicular to the connecting wall 31. Each branch portion 32 includes a stopping tab 33 extending upwardly from an inner side thereof and an guiding portion 34 at an outer side thereof. Each stopping tab 33 has a vertical engaging surface 331 facing the front wall 21 of the housing 2. Each guiding portion 34 includes an inclined guiding surface 341 extending upwardly and rearwardly. The vertical engaging surfaces 331 are adjacent to rear ends of corresponding inclined guiding surface 341. The guiding surface 341 provides multiple functions such as providing an inclined lead-in surface and a driving surface when the modular jack 100 engages with the RJ-45 plug. Each branch portion 32 further has a plurality of barbs 35 on both sides thereof for securely received in the groove 231 of the side wall 23 of the housing 2.

The terminal module 4 is provided for connecting with the RJ-45 plug and including an insulative base (not labeled), a daughter PCB (not labeled) supported by the base and a plurality of terminals 5. The base includes a pair of front latching portions 41 on both sides of a mating end thereof and a plurality of bolts (not labeled) securing the daughter PCB.

The shell 6 covering the insulative housing 2 is made of a metal sheet, including a plurality of grounding footer (not labeled).

Referring to FIGS. 1–4, in assembly, firstly, the anti-mismating member 3 is assembled to the housing 2 from the rear wall 22. The branch portions 32 are inserted into the corresponding grooves 231 with the barbs 35 of each branch portion 32 latched within respective one of the grooves 231. A front portion of each branch portion 32, which includes the stopping tab 33 and the guiding portion 34, extends forwardly into the cavity 24 of the housing 2. The connecting wall 31 of the anti-mismating member 3 abuts against the rear wall 22 of the housing 2. Secondly, the terminal module 4 is securely positioned in the housing 2 with the latching portions 41 thereof engaging with complemental portions of the housing 2. Each terminal 5 extends through a corresponding slit 221 of the housing 2 with contact portions thereof forwardly exposed in the cavity 24 for electrical connecting with the RJ-45 plug. Finally, the shell 6 covers the insulative housing 2.

Figure 4:
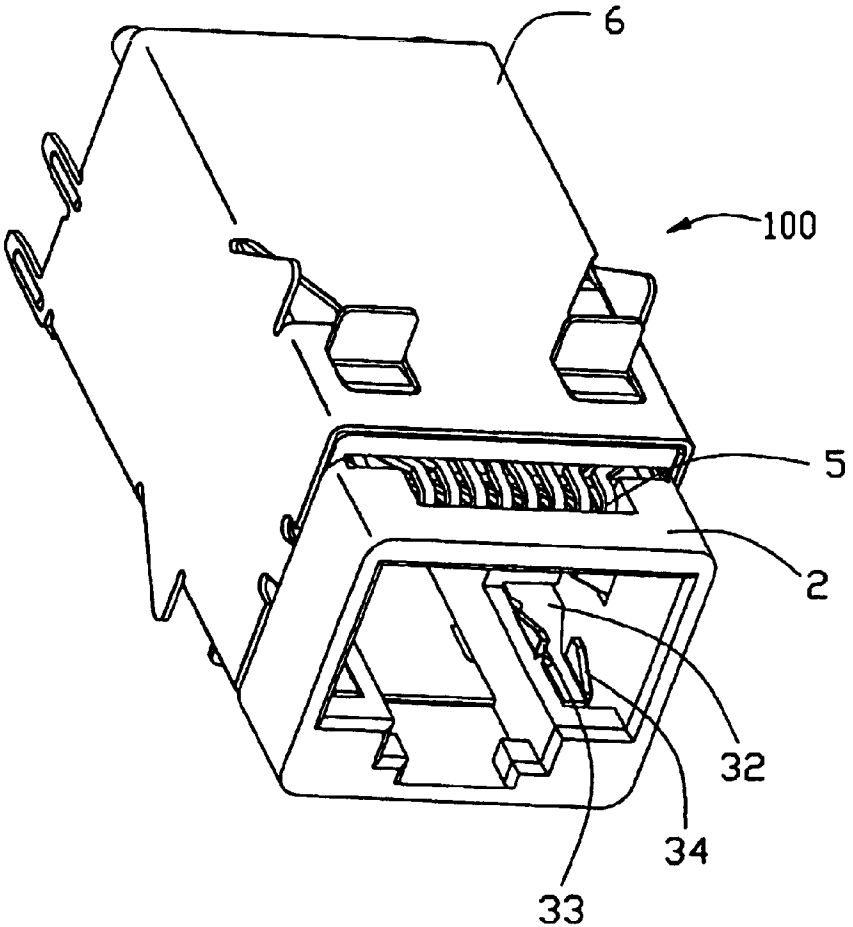
FIG. 4 is an assembled view of FIG. 1.

Operation of the modular jack 100 of the present invention will now be described with referenced to FIG. 4. The RJ-45 plug has an outer profile substantially corresponding to an inner profile of the plug receiving cavity 24. In other words, the width of RJ-45 plug is adequate to snuggly fit with the receiving cavity 24 of the modular jack 100. When the RJ-45 plug is inserted in the cavity 24 of the housing 2 and rids along the inclined guiding surface 341, the guiding portions 34 of each branch portion 32 of the anti-mismating member 3 are deflected downwardly by the inserted RJ-45 plug. The stopping tabs 33 of the anti-mismating member 3 move downwardly together with the guiding portions 34 and displace out of the RJ-45 plug insertion direction. As a result, the engaging surfaces 331 of the stopping tabs 33 can not interfere with the inserted RJ-45 plug. In this way, the RJ-45 plug can be successfully inserted into the modular jack 100, whereby contacts of the RJ-45 plug can electrically mate with the contact portions of the terminals 5. When the insertion RJ-45 plug disengages from the modular jack 100, the branch portions 32 of the anti-mismating member 3 move upwardly to their normal positions.

However, when an RJ-11 plug (not shown) is erroneously inserted through the receiving cavity 34, owing to a smaller width than the RJ-45 plug, the RJ-11 plug does not entirely fill the receiving cavity 34 and fails to engage with the guiding portion 34. As a result the branch portions 32 stay in their normal positions. The inserted RJ-11 plug abuts against the engaging surfaces 331 of the stopping tabs 33 prior to engagement with the contact portions of the terminals 5. Thus the stopping tabs 33 of the anti-mismating member 3 prevents RJ-11 plug from being fully inserted into the receiving cavity 24 and a reliable anti-mismating is obtained.

It should be noted that the anti-mismating member 3 of the modular jack 100 is discretely formed with the housing 2 and the branch portions 32 are integrally made of one metal sheet. The anti-mismating member 3 has a simple structure and a long life-span because of higher flexing resistant performance of the branch portion 32.

It is to be understood, however, further though numerous, characteristics and advantages of the present invention have been set fourth in the foregoing description, together with details of the structure and function of the invention, the disclosed is illustrative only, and changes may be made in detail, especially in matters of shape, size, and arrangement of parts within the principles of the invention to the full extent identify by the broad general meaning of the terms in which the appended claims are expressed.

What is claimed is:

1. A modular jack adapted for mating with a complementary plug comprising:

an insulative housing having a plug-receiving cavity for receiving the plug;

a plurality of terminals each having a contact portion extending into the plug-receiving cavity of the housing;

an anti-mismating member made integrally of a metal sheet and being discrete with the insulative housing, the anti-mismating member including a connecting wall abutting against the housing and a branch portion extending forwardly from the connecting wall and into the plug-receiving cavity, the branch portion including a stopping tab and a guiding portion at a front portion thereof, the stopping tab having an engaging surface facing forwardly, the guiding portion having an inclined guiding surface in front of the engaging surface; and a metal shell shielding the insulative housing;

wherein the stopping tab projects upright from an inner side of the branch;

wherein the guiding portion extends upwardly from an outer side of the branch;

wherein the insulative housing comprises a side wall and a rear wall, the side wall defining a groove communicating with the plug-receiving cavity, wherein the branch portion of the anti-mismating member is partially secured in the receiving groove;

wherein the connecting wall of the anti-mismating member abuts against the rear wall of the housing;

wherein the modular jack comprises a terminal module, the terminals secured in the terminal module.

2. The modular jack according to claim 1, wherein the branch portion has a plurality of barbs interferentially fitted with the groove.

* * * * *